United States Patent [19]

Nakamura

[11] Patent Number: 4,688,525

[45] Date of Patent: Aug. 25, 1987

[54] HYDRAULIC LASH ADJUSTER

[75] Inventor: Makoto Nakamura, Yokohama City, Japan

[73] Assignee: Nissan Motor Co., Ltd., Japan

[21] Appl. No.: 871,308

[22] Filed: Jun. 6, 1986

[30] Foreign Application Priority Data

Jun. 20, 1985 [JP] Japan ..... 60-93285[U]

[51] Int. Cl.[4] ..... F01L 1/14

[52] U.S. Cl. ..... 123/90.55

[58] Field of Search ..... 123/90.48, 90.52, 90.55, 123/90.57, 90.27

[56] References Cited

U.S. PATENT DOCUMENTS 3,380,440 4/1968 Thuesen ..... 123/90.27
3,509,858 6/1970 Scheibe et al. ..... 123/90.27
4,590,898 5/1986 Buente et al. ..... 123/90.55

FOREIGN PATENT DOCUMENTS 2935751 3/1981 Fed. Rep. of Germany ... 123/90.55
2941084 4/1981 Fed. Rep. of Germany ... 123/90.55
58-124011 7/1983 Japan .

*Primary Examiner*—Craig R. Feinberg
*Assistant Examiner*—David A. Okonsky
*Attorney, Agent, or Firm*—Leydig, Voit & Mayer

[57] ABSTRACT

In a lash adjuster for a valve train, a cuplike partition member is employed between a stationary plunger and an outer tubular member and formed with a radial air venting groove, a first axial air vent and a second axial air vent so that air bubbles, when supplied together with working oil to a first reservoir, are first vented through the radial air venting groove and a concentric air vent formed in the partition member, then vented, when supplied to an inner reservoir section, through the first axial air vent, the radial air venting groove and the concentric air vent, and further vented, when supplied to a second reservoir, through the second axial air vent, the radial air venting groove and the concentric air vent.

9 Claims, 5 Drawing Figures

HYDRAULIC LASH ADJUSTER

BACKGROUND OF THE INVENTION

1. Field of the Invention

The present invention relates to a hydraulic lash adjuster for taking up clearance or lash in a valve train of an internal combustion engine.

2. Description of the Prior Art

Such a lash adjuster of the kind referred to is known and may be mounted either between an engine valve stem and a valve operating cam or between one end of a rocker and its operating cam. An example of a lash adjuster mounted between an engine valve stem and a valve operating cam is shown in FIG. 5.

Referring to FIG. 5, a lash adjuster includes a main body 1 slidably installed in engine cylinder head 2 at a place adjacent an intake valve 3. The main body 1 consists of an outer tubular member 5 having an upper end wall 4 and an inner tubular member 7 secured at a lower outward flange 6 thereof to the outer tubular member 5. A first reservoir 8 is defined between the inner and outer tubular members 7, 5 and is communicated through an oil inlet port 9 formed in the outer tubular member 5 with an oil supply port 10 formed in the cylinder head 2. A stationary plunger 11 is disposed in the inner tubular member 7 and secured at the upper end thereof to the end wall 4 of the outer tubular member 5. The stationary plunger 11 has within the inside thereof a second reservoir 13 in fluid communication with the above described first reservoir 8 through first communication ports 12 formed in the inner end thereof. A movable plunger 14 is movably disposed between the inner tubular member 7 and the stationary plunger 11. The movable plunger 14 has within the inside thereof a high pressure chamber 16 which is in fluid communication through a second communication port 15 formed in the lower end portion of the stationary plunger 11 with the second reservoir 13. Within the high pressure chamber 16 there is disposed a ball valve 18 which is uged by springs 17, 17' in the direction closing the second communication port 15.

With the above arrangement, when a valve operating cam 19 is engaged at its base circle with the upper end wall 4 of the outer tubular member 5, namely, prior to lifting by the operating cam 19, oil from the oil supply passage 10 is introduced through the inlet port 9, the first reservoir 8 and through the first communication ports 12 to the second reservoir 13. Oil is then supplied through the second communication port 15 and the ball valve 18 in an opened state to the high pressure chamber 16, thus causing the movable plunger 14 and the main body 1 to move away from each other, i.e., in the opposite directions for thereby eliminating clearance between the operating cam 19 and the valve 3. On the other hand, when the operating cam 19 is engaged at its cam lobe with the upper end of the outer tubular member 5, namely, upon lifting by the operating cam 19, pressurized oil in the high pressure chamber 16 urges the ball valve 18 against its seating, thus confining pressurized oil within the high pressure chamber 16 and causing the main body 1 and the movable plunger 14 to move downward as an integral unit.

A disadvantage of the prior art lash adjuster is that it cannot function properly when air bubbles are contained in the working oil, resulting in a noisy and unsmooth operation of an associated valve train.

SUMMARY OF THE INVENTION

In accordance with the present invention, there is provided a novel and improved lash adjuster which comprises an outer tubular member having a closed upper end serving as a lash adjuster upper end, an inner tubular member disposed concentrically within the outer tubular member and having an outward flange at which it is secured to the outer tubular member, a source of fluid under pressure, a first reservoir defined between the inner and outer tubular member and in fluid communication with the source of fluid under pressure, a movable plunger slidably mounted in the inner tubular member, the movable plunger being tubular and having an open upper end and a closed lower end serving as a lash adjuster lower end, a stationary plunger slidably mounted in the movable plunger, the stationary plunger being tubular and having an open upper end and a closed lower end covered by an end wall, an opening provided to the upper open end of the stationary plunger, a second reservoir formed in the inside of the stationary plunger and in fluid communication through the opening with the first reservoir, a communication port formed in the end wall of the stationary plunger, a high pressure chamber defined between the movable plunger and the stationary plunger and in fluid communication with the second reservoir through the communication port, a check valve provided to the communication port to permit fluid flow only in one direction from the second reservoir to the high pressure chamber, a cuplike partition member having an upper end wall interposed between the open upper end of the stationary plunger and the upper end of the outer tubular member and a circumferential wall surrounding the upper ends of the stationary and movable plungers, biasing means disposed in the high pressure chamber for urging the stationary plunger together with the partition member against the upper end of the outer tubular member while urging the movable plunger away from the outer tubular member, the upper end of the outer tubular member being covered by an end wall formed with a concentric air vent, a radial air venting groove formed in an upper surface of the upper end wall of the partition member for providing communication between the first reservoir and the concentric air vent, a first axial air vent formed in the upper end wall of the partition member for providing communication between the first reservoir and the radial air venting groove, and a second axial air vent formed in the upper end wall of the partition member for providing the second reservoir and the radial air venting groove.

The above structure is quite effective for overcoming the above noted disadvantages and shortcomings inherent in the prior art device.

It is accordingly an object of the present invention to provide a novel and improved hydraulic lash adjuster for a valve train which is free from disadvantages and shortcomings resulting from air bubbles contained in working oil and assures a quiet and smooth operation of an associated valve train.

BRIEF DESCRIPTION OF THE DRAWINGS

The features and advantages of the hydraulic lash adjuster according to the present invention will become more clearly appreciated from the following description taken in conjunction with the accompanying drawings, in which.

DETAILED DESCRIPTION OF THE PREFERRED EMBODIMENTS

Figure 1:
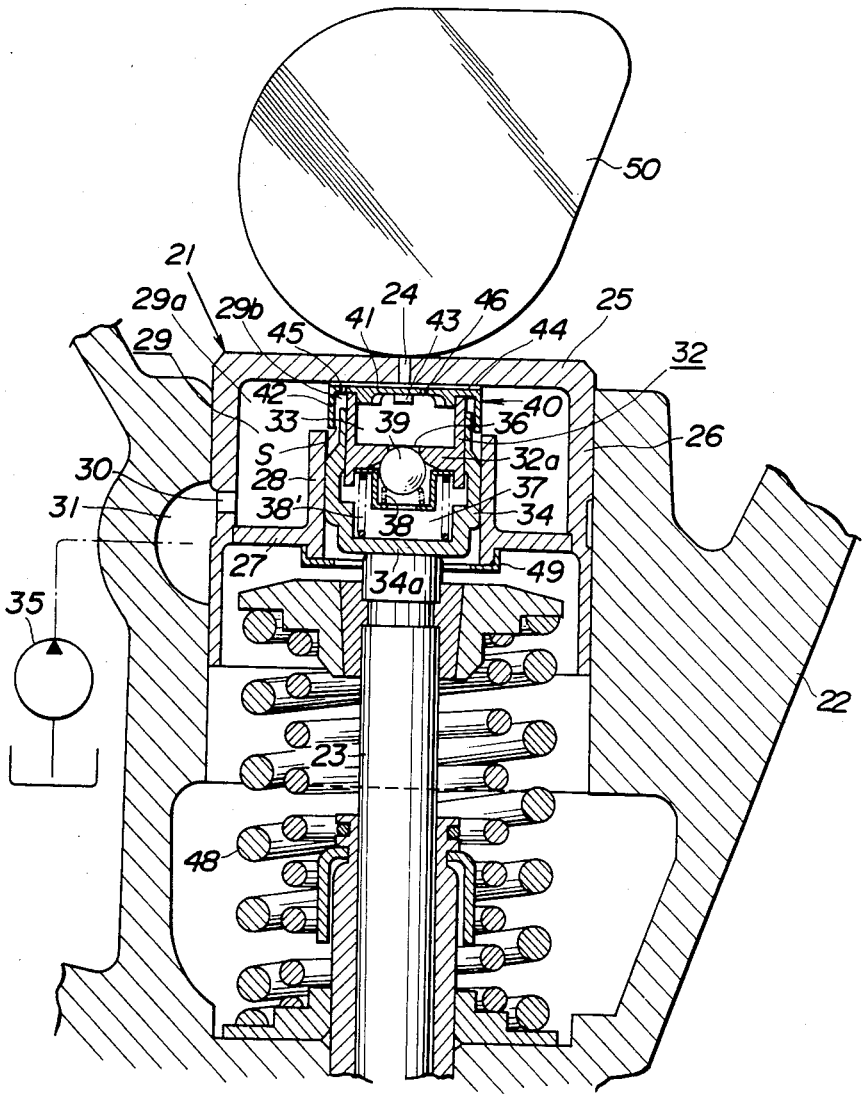
FIG. 1 is a sectional view of a hydraulic lash adjuster according to an embodiment of the present invention.

Referring to FIG. 1, a hydraulic lash adjuster according to an embodiment of the present invention is shown as comprising a main body 21 slidably mounted in an engine cylinder head 22 at a place above an upper end of a valve stem 23 which may be either of an intake valve or an exhaust valve. The main body 21 consists of an outer tubular member 26 of which upper end is covered by an end wall 25 formed with a concentric air vent 24, and an inner tubular member 28 disposed concentrically within the outer tubular member 26 and having adjacent a lower end thereof a radially outward flange 27 at which it is fixedly attached to the outer tubular member 26. A first reservoir 29 is defined between the inner and other tubular members 28, 26 and in fluid communication through an inlet port 30 formed in the circumferential wall of the outer tubular member 26 with an oil passage 31 formed in the cylinder head 22 and in fluid communication with a source of fluid under pressure such as an engine oil pump 35. A movable plunger 34, which is tubular and has an open upper end and a closed lower end 34*a*, is slidably mounted in the inner tubular member 28 and in contact at the lower end 34*a* with the upper end of the valve stem 23. A stationary plunger 32, which is tubular and of which lower end is covered by an end wall 32*a* having a concentric communication port 36, is slidably mounted in the movable plunger 34 to define therebetween a high pressure chamber 37. The stationary plunger 32 has within the inside thereof a second reservoir 33 in fluid communication through the communication port 36 with the high pressure chamber 37. Within the high pressure chamber 37 there is disposed a spring 38′ which urges the stationary plunger 32 and the movable plunger 34 toward the end wall 25 of the outer tubular member 26 and the upper end of the valve stem 23, respectively. Within the high pressure chamber 37 there is also disposed a ball valve 39 which is urged by a spring 38 in the direction closing the port 36.

Figure 2:
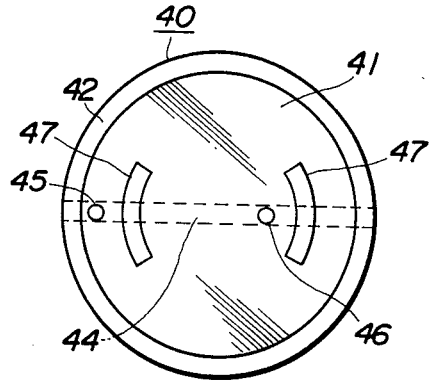
FIG. 2 is an enlarged bottom plan view of a partition member employed in the hydraulic lash adjuster of FIG. 1.

A partition member 40 is interposed between the end wall 25 of the outer tubular member 26 and an open upper end of the stationary plunger 32. As also shown in an enlarged scale in FIG. 2, the partition member 40 is in the form of a cuplike member having a top end wall 41 covering the open upper end of the stationary plunger 32 and a circumferential wall 42 surrounding the upper end portion of same. The upper end portion of the movable plunger 34 is reduced in thickness and surrounded by part of the circumferential wall 42 of the partition member 40 to define therebetween an annular space S. The top end wall 41 is clamped between the open upper end of the stationary plunger 32 and the end wall 25 of the outer tubular member 26 under the bias of the spring 28′. In this way, the partition member 40 surrounds the upper end portion of the stationary plunger 32 and the movable plunger 34 so as to divide the first reservoir 29 into an annular outer reservoir section 29*a* located outside of the partition member 40 and an annular inner reservoir section 29*b* located inside of the partition member 40 and around the upper end portion of the stationary plunger 32. The inner and outer reservoir sections 29*a*, 29*b* are fluidly connected to each other through the annular space S. The upper end of the stationary member 32 is formed with a plurality of rectangular notches or openings 43 through which the inner reservoir section 29*b* is fluidly connected with the second reservoir 33. The top end wall 41 of the partition member 40 is formed in the outer surface thereof with a radial air venting groove 44 extending diametrically throughout the diameter thereof. The air venting groove 44 cooperates with the end wall 25 of the outer tubular member 26 to define therebetween an air venting passage fluidly connected at the opposed ends thereof to the outer reservoir section 29*a*. The air venting groove 44, since extending diametrically of the top end wall 41, is in constant communication with the concentric air vent 24 irrespective of rotation of the partition member 40 relative to the outer tubular member 26. The top end wall 41 of the partition member 40 is also formed with a first axial air vent 45 adjacent the outer periphery thereof for providing communication between the air venting groove 44 and the inner reservoir section 29*b*. The end wall of the partition member 40 is also formed at a place adjacent the central portion thereof with a second axial air vent 46 for providing communication between the air venting groove 44 and the second reservoir 33. The partition member 40 also has projections 47 porojecting downward from the inner surface of the to end wall 41 for location thereof relative to the stationary plunger 32. In the meantime, indicated by the reference numeral 48 is a valve spring urging the valve in the direction of closing and by 49 a stopper for preventing the movable plunger 34 from being lowered beyond a predetermined level.

With the above arrangement, when the working oil containing air bubbles is introduced through the oil passage 31 to the outer reservoir section 29*a* of the first reservoir 29 under an operating condition prior to lifting by the operation cam 50, namely, under an operating condition in which the operating cam 50 is engaged at its base circle with the main body 21, the air bubbles are caused to rise in the working oil due to the buoyancy and vented to the outside of the lash adjuster through the radial air venting groove 44 and the concentric air vent 24. Further, the air bubbles still remaining in the working oil are caused to stagnate or trapped at the inner reservoir section 29*b* and vented to the outside of the lash adjuster through the first axial air vent 45, the radial air venting groove 44 and the concentric air vent 24. Accordingly, the air bubbles are almost completely excluded from the working oil when the working oil passes through the inner reservoir section 29*b*. A quite small quantity of air bubbles may still remain in the working oil to be supplied through the inner reservoir section 29*b* to the second reservoir 33 but will be caused to rise and vented to the outside of the lash adjuster through the second axial air vent 46, the radial air venting groove 44 and the concentric air vent 24. For this reason, the working oil supplied to the high pressure chamber 37 is assuredly prevented from containing air bubbles. As a result, the lash adjuster can function properly without being affected by air bubbles contained in working oil, thus making it possible to attain a guiet and smooth operation of an associated valve train.

In the above, it is to be noted that the partition member 40 is formed to be smaller in diameter than the lower end portion of the movable plunger 34 so that the stationary plunger 32 and the movable plunger 34 can be installed in place after assemblage of the inner and outer tubular members 28, 26. This contributes to an easy and efficient assembly work.

Figure 3:
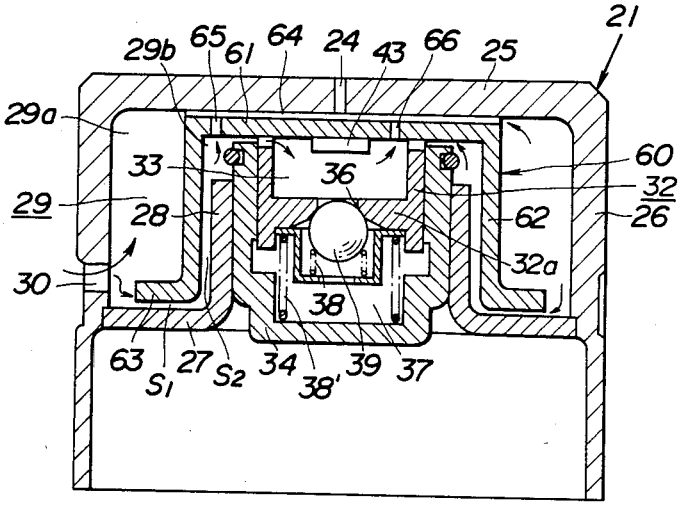
FIG. 3 is a hydraulic lash adjuster according to a modification of the present invention.
Figure 4:
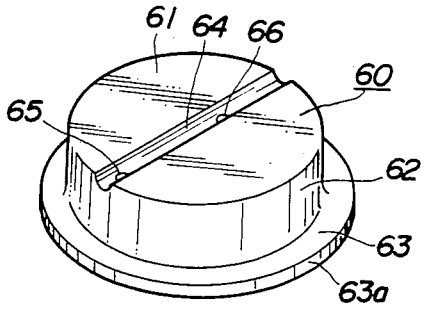
FIG. 4 is a perspective view of a partition member employed in the hydraulic lash adjuster of FIG. 3.
Figure 5:
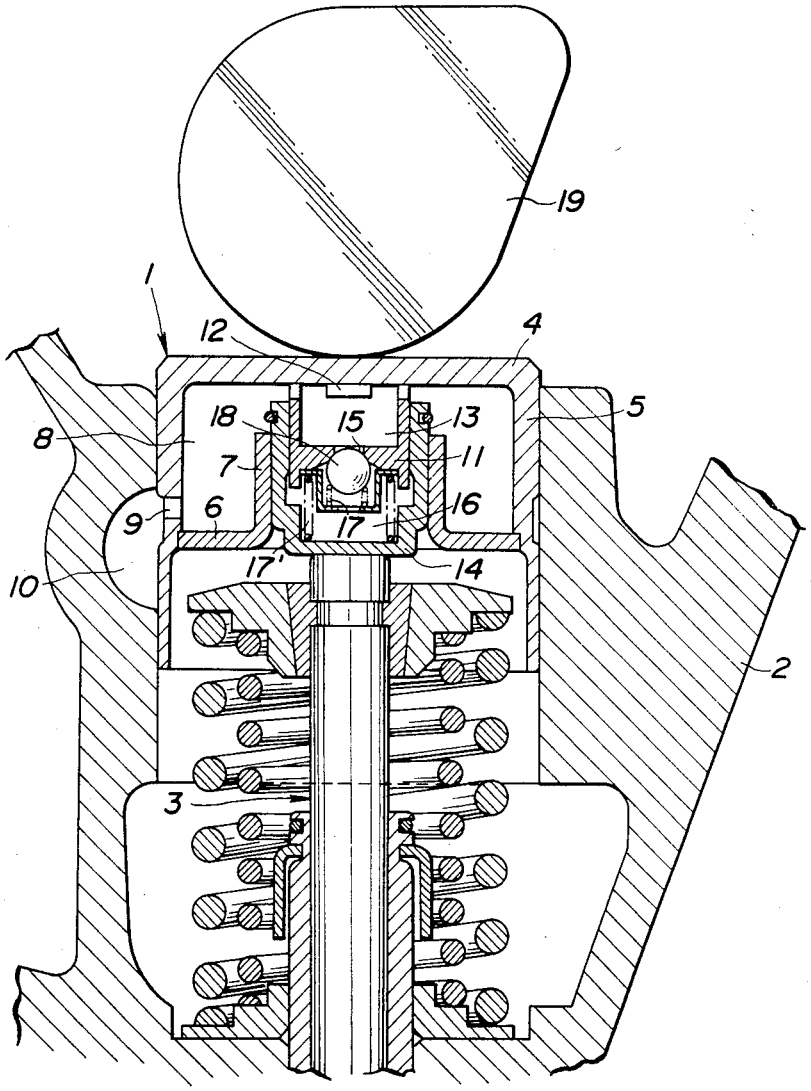
FIG. 5 (PRIOR ART)
FIG. 5 is a sectional view of a prior art hydraulic lash adjuster.

Referring to FIGS. 3 and 4, in which like or corresponding parts to those of the previous emboidiment are designated by the like reference characters, a modified embodiment will be described.

This embodiment differs from the previous embodiment in that a different partition member 60 as shown in FIG. 4 is employed. Specifically, the partition member 60 is in the form of a hat and includes a circular circumferential wall 62 of which inner diameter is larger than the outer diameter of the inner tubular member 28, a top end wall 61 covering the upper end of the inner tubular member 28 and a radially outward flange 63 at the lower end of the circumferential wall 62. The outward flange 63 cooperates with the flange 27 of the inner tubular member 28 to define therebetween an open space $S_1$ in fluid communication with the outer reservoir section 29*a*, while the circumferential wall 62 cooperates with the inner tubular member 28 to define therebetween an open space $S_2$ for providing communication between the space $S_1$ and the inner reservoir section 29*b*. The space $S_1$ is positioned lower than the port 30 so as to make it difficult for air bubbles to enter thereinto. The upper end portion of the movable plunger 34 needs not to be reduced in thickness as that in the previous embodiment. Except for the above, this embodiment is substantially similar to the previous embodiment, and a radial air venting groove 64, a first axial air vent 65 and a second axial air vent 6 corresponds to the radial air venting groove 44, first axial air vent 45 and the second axial air vent 46, respectively.

With the above arrangement, air bubbles contained in working oil supplied from the inlet port 30 are prevented with an increased efficiency from being delivered to the inner reservoir section 29*b*. Except for the above, this embodiment can produce substantially the same effect as the previous embodiment.

What is claimed is:

1. A hydraulic lash adjuster comprising:

an outer tubular member having a closed upper end serving as a lash adjuster upper end;

an inner tubular member disposed concentrically within said outer tubular member and having an outward flange at which it is secured to said outer tubular member;

a source of fluid under pressure;

a first reservoir defined between said inner and outer tubular members and in fluid communication with said source of fluid under pressure;

a movable plunger slidably mounted on said inner tubular member, said movable plunger being tubular and having an open upper end and a closed lower end serving as a lash adjuster lower end;

a stationary plunger slidably mounted in said movable plunger, said stationary plunger being tubular and having an open upper end and a closed lower end covered by an end wall;

an opening provided to said open upper end of said stationary plunger;

a second reservoir formed in the inside of said stationary plunger and in fluid communication through said opening with said first reservoir;

a communication port formed in said end wall of said stationary plunger;

a high pressure chamber defined between said movable plunger and said stationary plunger and in fluid communication with said second reservoir through said communication port;

a check valve provided to said communication port to permit fluid flow only in one direction from said second reservoir to said high pressure chamber;

a cuplike partition member having an upper end wall interposed between said open upper end of said stationary plunger and said upper end of said outer tubular member and a circumferential wall surrounding said upper ends of said stationary and movable plungers;

biasing means disposed in said high pressure chamber for urging said stationary plunger together with said partition member against said upper end of said outer tubular member while urging said movable plunger away from said outer tubular member;

said upper end of said outer tubular member being covered by an end wall formed with a concentric air vent;

a radial air venting groove formed in an upper surface of said upper end wall of said partition member for providing communication between said first reservoir and said concentric air vent;

a first axial air vent formed in said upper end wall of said partition member for providing communication between said first reservoir and said radial air venting groove; and a second axial air vent formed in said upper end wall of said partition member for providing said second reservoir and said radial air venting groove.

2. A hydraulic lash adjuster as set forth in claim 1, in which said radial air venting groove is disposed diametrically of said upper end wall of said partition member to extend throughout the diameter of same.

3. A hydraulic lash adjuster as set forth in claim 2, in which said partition member separates said first reservoir into an outer reservoir section outside thereof and an inner reservoir section inside thereof, said circumferential wall of said partition member cooperating with said upper end of said movable plunger to define therebetween an annular space for providing communication between said inner and outer reservoir sections, said inner reservoir section being in fluid communication through said first axial air vent with said radial air venting groove and through said opening with said second reservoir.

4. A hydraulic lash adjuster as set forth in claim 3, in which said circumferential wall of said partition member is of an outer diameter which is smaller than that of said movable plunger.

5. A hydraulic lash adjuster as set forth in claim 4, in which said upper end of said movable plunger is reduced in diameter.

6. A hydraulic lash adjuster as set forth in claim 2, in which said partition member further comprises at a lower end of said circumferential wall an outward flange which cooperates with said outward flange of said inner tubular member a second space for providing communication between said first mentioned space and said outer reservoir section.

7. A hydraulic lash adjuster as set forth in claim 6, in which said outer tubular member has a circumferential wall formed with an inlet port providing communication between said outer reservoir section and said source of fluid under pressure, said second space being positioned lower than said inlet port.

8. A hydraulic lash adjuster as set forth in claim 1, further comprising means for slidably mounting therein said outer tubular member.

9. A hydraulic lash adjuster as set forth in claim 8, in which said mounting means comprises a cylinder head, said upper end of said outer tubular member being in contact with an operating cam of a valve train while said lower end of said movable plunger being in contact with an end of a valve stem.

* * * * *